United States Patent [19]

Whaley et al.

[11] Patent Number: 4,477,339

[45] Date of Patent: Oct. 16, 1984

[54] CYCLONE CLASSIFIER

[76] Inventors: John P. Whaley, 342 Farallone Ave., Fircrest, Wash. 98466; Carl J. Gaul, c/o Universal Seafoods, Dutch Harbor, Ak. 99692

[21] Appl. No.: 412,054

[22] Filed: Aug. 27, 1982

[51] Int. Cl.[3] ..... B04C 3/00

[52] U.S. Cl. ..... 209/22; 209/144; 55/431

[58] Field of Search ..... 209/144, 21–23; 55/431, 449, 452, 459 C, 459 D, 459 R

[56] References Cited

U.S. PATENT DOCUMENTS

| | | | |
|---|---|---|---|
| 938,656 | 5/1908 | Frickey | 55/459 R |
| 1,680,243 | 9/1928 | Becker | 209/144 |
| 2,638,218 | 5/1953 | Simpson et al. | 209/144 |
| 2,890,764 | 6/1959 | Arnold | 209/144 |
| 2,991,883 | 7/1961 | Hendrickson et al. | 209/144 |
| 3,341,011 | 9/1967 | Prescott | 209/144 |
| 3,513,642 | 7/1968 | Cornett | 209/144 |
| 4,269,701 | 5/1981 | Höck et al. | 209/144 |

OTHER PUBLICATIONS

Rader Companies Cyclo-Screen Separator brochure, 2/77.

*Primary Examiner*—Frank W. Lutter
*Assistant Examiner*—Wm. Bond

[57] ABSTRACT

The invention is a cyclone-type particle classifier. It comprises an upper body section, with an inlet for a particle laden gas, and a lower conical section where classification occurs. The lower section comprises an inner foraminous portion and a coaxial outer solid walled portion. These are separated so as to define an annular-shaped volume between them. The two lower sections are further separated at their upper basal portion by an air gap which is in communication with the annular volume and the ambient atmosphere. The annular space is connected to one outlet duct at its apex while the inner volume of the foraminous portion is connected to another duct. These ducts lead to the suction side of appropriate fans. The two ducts serve as the only gas outlet means from the device.

13 Claims, 3 Drawing Figures

CYCLONE CLASSIFIER

BACKGROUND OF THE INVENTION

The present invention comprises a cyclone-type particle classifier which contains a foraminous inner cone contained within a solid-walled outer cone. An air gap is present between the two cones in the area where they join the main body of the cyclone. The apparatus lacks the usual top exhaust for particle-free air.

Cyclone separators for removing solid materials from a gas stream have been available for approximately the last century. Within 15 years of their introduction into the engineering community, designs were available which served not only a separating function, but a particle classifying function as well. Examples are seen in U.S. Pat. Nos. 687,226 to Raymond, and 1,165,866 to Fraser.

The art has developed significantly from that early time. One approach to using a cyclone as a classifier involves the use of an inner foraminous cone within an outer solid cone. In most cases, the coarse material is retained within the annular space between the two cones, while the finer material passes through the foraminae and is exhausted from the top of the cylone. Apparatus of this type is shown in U.S. Pat. No. 3,513,642 to Cornett. A similar apparatus, in which two streams are exhausted from the bottom of the cyclone, is shown in U.S. Pat. No. 3,341,011 to Prescott. Other examples of cyclone-type classifiers are seen in U.S. Pat. Nos. 3,615,008 to Alpha, and 3,667,600 to Oi et al.

Shumate (*Proceedings, Particleboard Symposium*, Washington State University, 5:243–261, 1971) gives an engineering and historical summary of various types of cyclone separators. In this paper he states, "Numerous attempts have been made to make a cyclone act as a classifier by installing an inner cone of perforated metal or woven wire. These have met with indifferent success, depending upon the material being screened."

One commercial unit containing a perforated inner core is in use primarily for screening heavy trash from pulp chips. This unit has apparently been commercially successful because of the relatively large difference in size and specific gravity between the accepted and rejected fractions. However, as Shumate notes, classifiers based on cyclones have been far less successful where the size and specific gravity differences between accepted and rejected portions are small or nonexistent.

SUMMARY OF THE INVENTION

The present invention is a cyclone-type particle classifier which is particularly useful in the separation of fibrous from nonfibrous particles. It comprises a generally cylindrical upper section or body having a tangential gas inlet means and a relatively conventional inner coaxial, generally cylindrical tub or baffle means. Unlike a conventional cyclone, the top is closed and the tub does not also serve as an exit conduit for particle-free gas. The device further contains a lower section which has coaxial inner and outer portions. These are of conventional configuration and are of generally frustoconical shape. The outer portion is solid walled, while the inner portion is foraminous and preferably of greater included angle than the outer portion. The two portions define an annular space which may increase in width from the base towards the apex. The outer portion completely encloses the inner portion. The inner foraminous portion of the lower section has a base of essentially the same diameter as the upper section and it is joined to it in a coaxial end-to-end relationship. The outer solid-walled portion of the lower section also has a base of essentially the same or somewhat larger diameter than the upper section. However, it is displaced in order to provide a gap between the outer portion of the lower section and the upper section, and between the solid outer and inner foraminous portions of the lower section. This gap is open to the ambient atmosphere. Both portions of the lower section will typically have truncated tips which are in communication with separate exiting ducts. These are constructed so that the annular space between the portions of the lower section communicates with a first duct and the inside or interior volume of the inner foraminous portion communicates with a second duct.

In use, the cyclone classifier will receive the material to be classified in a suspension in a gaseous stream admitted to the inlet duct. This gas stream is formed into vortical flow in the upper portion of the device. It then descends into the volume contained within the foraminous portion of the lower section. At the same time, air or other ambient gas is drawn into the lower section through the gap between the two portions. The smaller particles pass through the foraminae into the annular space and are drawn off through the first duct. The relatively coarser particles are retained within the volume of the inner portion and exit via the second duct.

It is an object of the present invention to provide a simple and effective cyclone-type particle classifier.

It is a further object to provide a cyclone-type classifier that will effectively separate fibrous from nonfibrous materials.

It is another object to provide a cyclone-type classifier that can effectively separate materials having similar specific gravities.

These and many other objects will become readily apparent to one skilled in the art upon reading the following detailed description taken in conjunction with the drawings.

DESCRIPTION OF THE PREFERRED EMBODIMENTS

Figure 2:
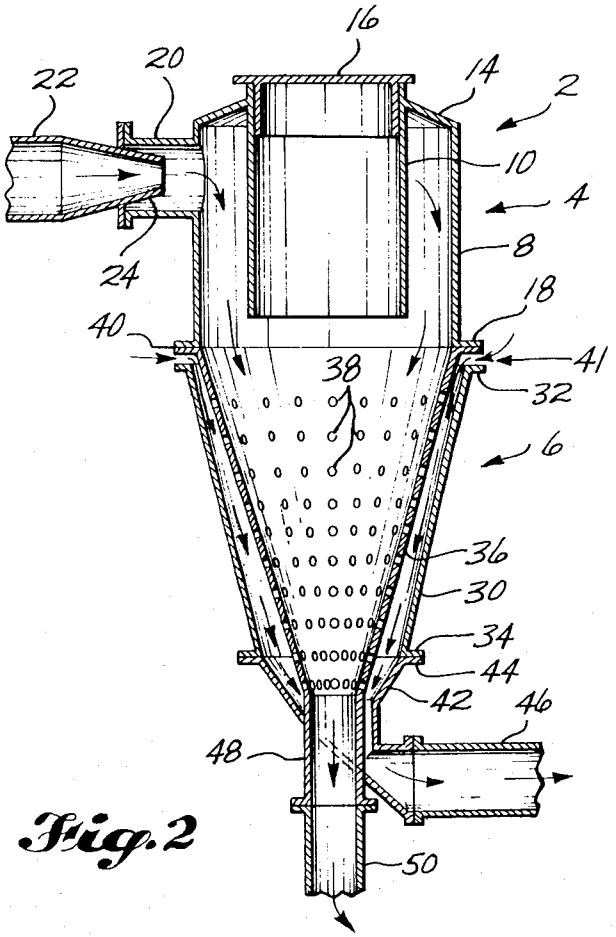
FIG. 2 shows a vertical section through the classifier.
Figure 1:
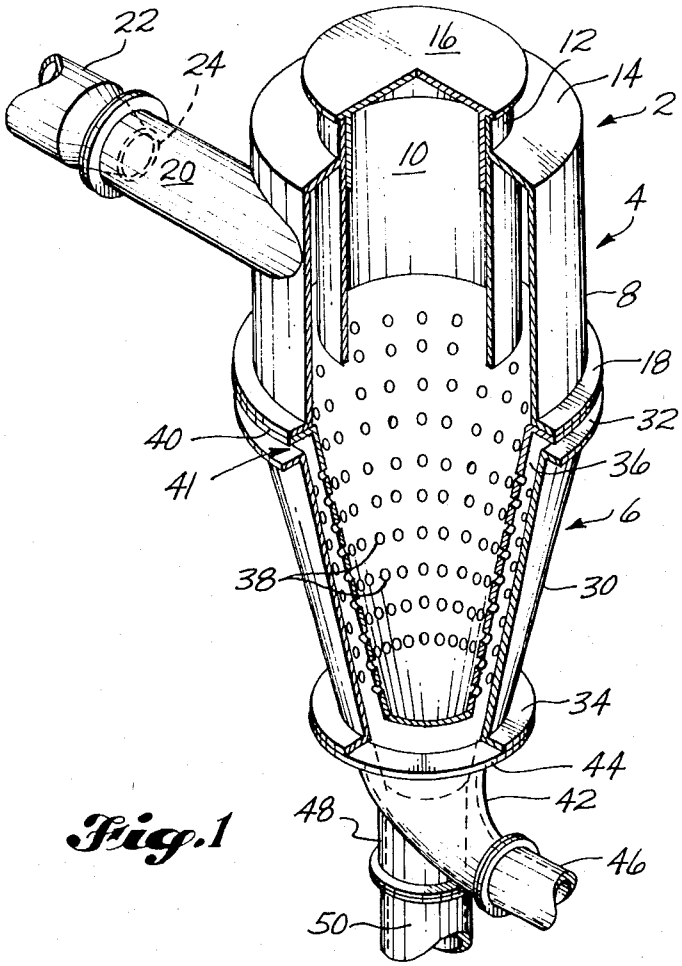
FIG. 1 shows a partially cut away perspective view of the classifier.
Figure 3:
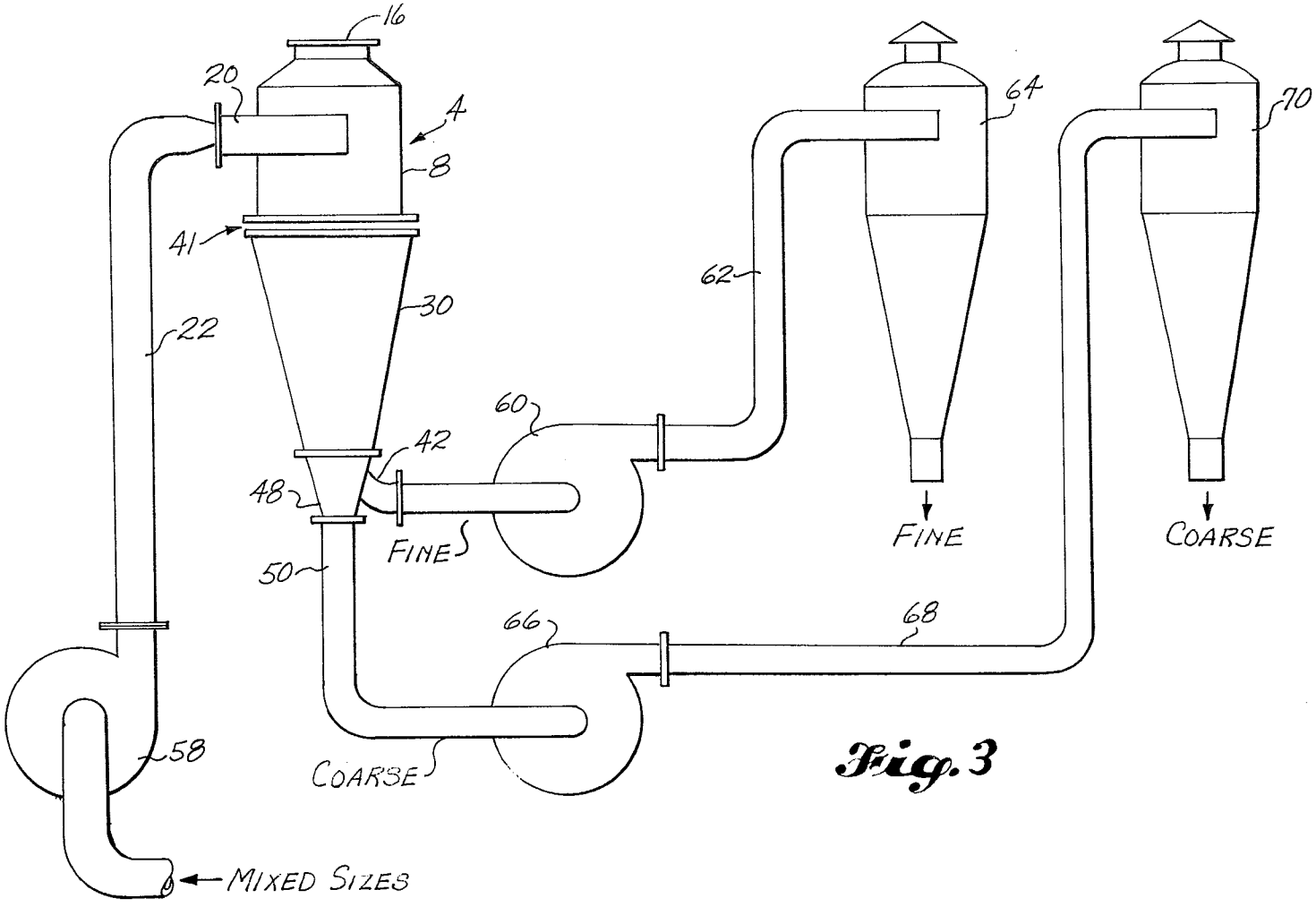

The apparatus shown in the drawings is exemplary of the present invention. It will be apparent to those skilled in the art that many variations can be made without departing from the spirit of the invention. Reference to the two drawings indicates the cyclone-type classifier 2 as comprising an upper section, generally indicated at 4, and a lower section, generally shown as 6. The upper section comprises a body 8, which will usually be made of sheet metal, as will the rest of the device. This contains a conventionally located tub or interior baffle 10 which may or may not contain an extension 12. The body has a top 14, which extends from the periphery so as to form a tight seal with the tub. The tub has a tight-fitting cover 16. This is shown in the drawing as a separate piece which telescopes into the top of the tub. It would be equally feasible for the top 14 and cover 16 to be a simple solid disc or domed portion; however, it is somewhat more difficult to construct the device in this manner. The body will most conveniently have a flange 18 at its lower edge, although this also is optional. An inlet duct 20 enters the body tangentially and serves as a conduit for the particle-laden gas entering the device. This may be either round or of rectangular construction, the latter being usually preferred. Other conventional gas inlet arrangements such as helical or involute are also satisfactory. For some applications, it is convenient to increase the inlet velocity by the use of a nozzle 24 which is seen on the end of duct 22 as it enters the inlet section 20.

The lower section 6 of the device contains an outer solid-walled cone 30 and an inner foraminous cone 36. Outer cone 30 conveniently has an upper flange 32 and lower flange 34. Upper flange 32 can be tied to body flange 18 by the use of spacer bolts, not shown, or other convenient means which will give a rigid construction yet permit the width of gap 41 to be properly maintained.

The inner cone 36 contains an upper flange 40 which would also be bolted or otherwise attached to body flange 18. It contains a series of foraminae 38 which are shown here as round holes. Many other patterns of openings would be quite suitable, such as slots, or square or rectangular holes such as might be defined by a woven screen.

Both cones are truncated to a frustro-conical shape to accept outlet ducts. The outer cone ends in a transition piece 42 containing a flange 44 which is bolted or otherwise attached to lower flange 34 of the outer cone. This transition piece ends in a first duct 46 which serves as a conveying means for transporting a fine particle-laden gas to a particle separation system. A nozzle piece 48 serves as an extension to inner foraminous cone 36. This passes through the lower wall of transition piece 42 and terminates in a second duct 50 which carries the larger or irregularly-shaped particles to a recovery system. The outlet of the transition piece will normally be angled at about 45°–90° from the longitudinal axis of the cyclone to simplify piping.

Using the type of construction shown in the drawings and following example, the width of gap 41 will be in a range from 0.02 to 0.075 times the diameter of the body. This will depend somewhat on the clearance desired between the inner and outer cones which, in turn, controls the dimensional parameters of the annular space between them. There are several ways of controlling the size and shape of the annular space. The outer cone can have the same base diameter and included angle as the inner cone and simply be longitudinally displaced from it. The outer cone might have a short cylindrical section at its upper portion and also be displaced as above so as to form a generally wider annular space. The outer cone could also have a larger base diameter but similar included angle to the inner cone. In this case the gap could be oriented horizontally or have both a horizontal and vertical component if the outer cone was also longitudinally displaced. Another construction is to have the outer cone of the same base diameter as the inner cone but of smaller included angle. The annular space, in this case, increases in width as the apex of the cones is approached. Combinations of these constructions are possible.

The shape, size, and number of foraminae within the inner cone will depend somewhat on the materials being separated. In general, this cone should possess at least 20%, and up to as much as 60%, open area.

Example

The following example describes an embodiment of the present invention used for recovery of fiber from disposable diapers which are being recycled because of some manufacturing defect. The main body of the cyclone is approximately 107 cm in diameter and 108 cm from extreme top to the flange. The inlet duct is square and is 30.5 cm on each side. The tub portion is 63.5 cm in diameter and is 99 cm long. This terminates 9 cm above the flange on the body. The outer solid-walled cone is 119 cm in height from flange to flange and is made with an included angle of 26°. It is 61 cm in diameter at the bottom flange. The inner cone is slightly shorter than the outer cone and is 28 cm in diameter at the outlet. It is perforated with round holes, 2.2 cm in diameter, punched on a center-to-center distance of 3.2 cm and arranged on a 20° descending spiral pattern. This section has approximately 41% open area. The inner cone has a greater included angle than the outer cone; in this case 38°. There is a 2.5 cm air gap between the upper flanges of the inner and outer cones.

In order to increase inlet velocity into the separator, the device was equipped with an inlet nozzle which tapered from a 30.5 cm diameter round duct to a 15 cm diameter round duct over a 55 cm distance. In the present case, the higher entrance velocity greatly improved the separation efficiency. This same effect could probably be achieved through selection of a fan with a high output velocity.

Air is supplied to the inlet of the apparatus by a fan 58 delivering approximately 71 $m^3$ per minute carrying a fiber load factor of approximately 0.049 $kg/m^3$. Load factors varying between approximately 0.015 to 0.16 $kg/m^3$ have been found to be satisfactory. It will be understood that separation efficiencies will be somewhat higher at the lower load factors. The outlet duct leading from the annular space between the two cones and which carries the accepted fiber enters the suction of a fan 60 having a delivery capability equal to the inlet fan. Scrap material, principally elastic, attachment tapes, and shredded polyethylene film, leaves via the duct leading from the interior of the foraminous cone to a fan 66 which delivers 36 $m^3$/minute. This volume corresponds approximately to the amount of ambient air drawn in through the gap between the outer cone and the body section. Fans 60 and 66 communicate with any standard particle recovery means such as ducts 62, 68 in communication with conventional cyclones 64, 70. Fiber recovery is achieved at approximately 70% efficiency. It has been experimentally determined that the volumetric flow in the line carrying the scrap material should preferably be between 0.8 and 1.0 times the flow into the inlet nozzle for optimum efficiency.

Having thus described the best mode known to the inventor of practicing the invention, it will be apparent that many variations can be made. For example, the apparatus has been described in a connotation in which the body section is located at the top, with the cone located at the bottom along a vertical axis. It is not essential that the apparatus be operated in this configuration.

What is claimed is:

1. A cyclone-type particle classifier which comprises an upper section for forming a particle carrying gas stream into vortical flow and a lower section for classifying the particles;

a. the upper section being of generally cylindrical configuration and having a gas inlet means and an inner, generally cylindrical tub baffle means, the entire top portion of the upper section and tub baffle means being closed;

b. the lower section having coaxial inner and outer portions of inverted, generally frustro-conical shape, the outer portion being solid-walled and the inner portion being foraminous and having a base of essentially the same diameter as the upper section and being mounted thereto in a coaxial end-to-end relationship;

c. the outer solid-walled portion of the lower section having a base of essentially the same diameter as the upper section, but being displaced therefrom to provide an open gap therebetween and create an annular space between the two portions of the lower section, the outer portion completely enclosing the inner portion except in the area of the gap; the gap being open to the ambient atmosphere outside the classifier;

d. the two portions of the lower section having truncated tips in communication with separate ducts, so that the annular space between the portions communicates with a first duct and the interior volume of the inner portion communicates with a second duct, e. means for inducing a pressure drop across the classifier so that during use ambient gas is drawn into the gap;

whereby, when in use, the relatively finer particles in the gas stream will pass through the foraminae of the inner portion into the annular space and will be exhausted through the first duct and the relatively coarser particles will be retained within the portion and be exhausted through the second duct.

2. The classifier of claim 1 including a transition piece between the tip section of the outer portion of the lower section and the first duct so that the duct is taken off at an angle from the longitudinal axis of the classifier.

3. The classifier of claim 2 in which the angle between the longitudinal axis and first duct is between 45° and 90°.

4. The classifier of claims 2 or 3 in which the second duct is oriented along the longitudinal axis of the classifier and is passed through a wall of the transition piece.

5. The classifier of claim 1 in which the inner portion of the lower section has a greater included angle than the outer portion so that the annular space between the two portions increases in width from the base toward the apex.

6. The classifier of claim 5 including a transition piece between the tip section of the outer portion of the lower section and the first duct so that the duct is taken off at an angle from the longitudinal axis of the classifier.

7. The classifier of claim 6 in which the angle between the longitudinal axis and first duct is between 45° and 90°.

8. The classifier of claims 6 or 7 in which the second duct is oriented along the longitudinal axis of the classifier and is passed through a wall of the transition piece.

9. The classifier of claims 1 or 5 in which the gap between the upper section and outer section of the lower section is at least 0.02 times the diameter of the upper section.

10. The classifier of claim 9 in which the gap is between 0.02 and 0.075 times the diameter of the upper section.

11. The classifier of claim 10 in which the foraminous portion of the lower section has at least 20% open area.

12. The classifier of claim 11 in which the open area is between 20% and 60%.

13. The process of separating nonfibrous from short fibered material comprising:

a. providing a cyclone-type classifier having an upper section for forming a particle carrying gas stream into vortical flow and a lower section for classifying the particles;

the upper section being generally cylindrical with a gas inlet means and an inner coaxial generally cylindrical tub baffle means, the entire top portion of the upper section and tub baffle means being closed;

the lower section having coaxial inner and outer portions of inverted, generally frusto-conical shape, the outer portion being solid-walled and the inner portion being foraminous and having a base of essentially the same diameter as the upper section and being mounted thereto in a coaxial end-to-end relationship;

the outer solid-walled portion of the lower section having a base of essentially the same diameter as the upper section, but being displaced thereform to provide an open gap therebetween and create an annular space between the two portions of the lower section, the outer portion completely enclosing the inner portion except in the area of the gap; the gap being open to the ambient atmosphere outside the classifier;

the two portions of the lower section having truncated tips in communication with separate ducts, so that the annular space between the portions communicates with a first duct and the interior volume of the inner portion communicates with a second duct;

whereby, when in use, the relatively finer particles in the gas stream will pass through the foraminae of the inner portion into the annular space and will be exhausted through the first duct and the relatively coarser particles will be retained within the portion and be exhausted through the second duct;

b. supplying the material to be separated to the inlet means of the classifier while in suspension in a moving gas stream;

c. directing the first duct carrying the fibrous material and the second duct conveying the nonfibrous material to the suction sides of individual fans so as to induce ambient gas flow through the gap into the annular space and provide a greater pressure drop across the classifier than would be obtained solely from the use of an inlet side fan; and d. separating the suspended material from the respective exiting gas streams.

* * * * *